US008827122B2

(12) United States Patent
Dennis et al.

(10) Patent No.: US 8,827,122 B2
(45) Date of Patent: Sep. 9, 2014

(54) NON-FLAMMABLE PLASTIC AEROSOL

(75) Inventors: Stephen R. Dennis, Pleasanton, CA (US); Rashda K. Khan, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 222 days.

(21) Appl. No.: 13/087,729

(22) Filed: Apr. 15, 2011

(65) Prior Publication Data

US 2012/0261439 A1 Oct. 18, 2012

(51) Int. Cl.
*B65D 83/00* (2006.01)
*B65D 83/38* (2006.01)

(52) U.S. Cl.
CPC ..... *B65D 83/38* (2013.01)
USPC ..... 222/402.1; 222/394; 510/279

(58) Field of Classification Search
CPC ..... B65D 83/14; B65D 83/38; B65D 83/48; C11D 17/0043; C11D 7/24; C09K 3/30; A61M 11/02
USPC ..... 222/394, 402.1, 192, 402.18; 510/279, 510/177, 406–408, 412; 239/372, 579; 516/8.1
See application file for complete search history.

(56) References Cited

U.S. PATENT DOCUMENTS 2,900,301 A * 8/1959 Schmidt ..... 424/43
3,137,416 A * 6/1964 Shepherd et al. ..... 222/192
3,159,535 A * 12/1964 Sesso et al. ..... 424/45
4,117,958 A 10/1978 Spitzer et al.
RE30,093 E * 9/1979 Burger ..... 222/95
4,173,643 A * 11/1979 Law ..... 514/372
4,329,417 A * 5/1982 Nagatani et al. ..... 430/264
4,350,605 A * 9/1982 Hughett ..... 516/7
4,393,984 A 7/1983 Debard
4,396,152 A * 8/1983 Abplanalp ..... 239/337
4,472,283 A * 9/1984 Brooks ..... 210/698
5,027,985 A 7/1991 Abplanalp
5,152,411 A 10/1992 Pope et al.
5,199,615 A 4/1993 Downing et al.
5,337,929 A 8/1994 Van der Heijden
5,553,753 A 9/1996 Abplanalp
5,605,258 A 2/1997 Abplanalp
5,705,604 A * 1/1998 Fang ..... 528/397
5,915,598 A 6/1999 Yazawa et al.
5,935,554 A * 8/1999 Tomlinson ..... 424/45
6,235,265 B1 * 5/2001 Logsdon ..... 424/45
6,346,232 B1 * 2/2002 Schultz et al. ..... 424/45
6,390,326 B1 5/2002 Hung
6,491,187 B2 12/2002 Walters
6,959,524 B2 11/2005 Altonen et al.
7,028,866 B2 4/2006 Kunesh et al.
7,303,087 B2 12/2007 Flashinski et al.

(Continued)

FOREIGN PATENT DOCUMENTS

CN 101653435 * 2/2010

OTHER PUBLICATIONS

Machine Translation for CN101653435.*

*Primary Examiner* — Frederick C Nicolas
(74) *Attorney, Agent, or Firm* — Erin Collins

(57) ABSTRACT

Described is a plastic aerosol device having a vapor tap valve orifice and an aqueous product composition containing a non-flammable hydrofluorocarbon propellant and a flammable alcohol solvent. The composition can additionally contain a alcohol co-solvent such as triethylene glycol and a quaternary antibacterial agent.

12 Claims, 2 Drawing Sheets

(56) References Cited

U.S. PATENT DOCUMENTS

| | | | | |
|---|---|---|---|---|
| 7,344,707 | B2 | 3/2008 | Smith | |
| 7,448,517 | B2 | 11/2008 | Shieh et al. | |
| 8,025,189 | B2 * | 9/2011 | Salameh | 222/402.1 |
| 8,088,829 | B2 * | 1/2012 | Martin | 514/699 |
| 8,231,863 | B2 * | 7/2012 | Cronk | 424/45 |
| 8,276,835 | B2 * | 10/2012 | Lowry et al. | 239/492 |
| 8,297,479 | B2 * | 10/2012 | Hoefing et al. | 222/382 |
| 2003/0215400 | A1 | 11/2003 | Schroeder et al. | |
| 2006/0269484 | A1 * | 11/2006 | Knopeck et al. | 424/45 |
| 2007/0194040 | A1 * | 8/2007 | Tasz et al. | 222/4 |
| 2010/0096414 | A1 * | 4/2010 | Dennis | 222/383.1 |
| 2010/0187195 | A1 * | 7/2010 | Jamieson et al. | 215/386 |
| 2011/0108581 | A1 * | 5/2011 | Dennis | 222/382 |
| 2011/0121039 | A1 * | 5/2011 | Dennis | 222/383.1 |
| 2011/0163184 | A1 * | 7/2011 | Dennis | 239/315 |
| 2011/0318277 | A1 * | 12/2011 | Dalby et al. | 424/45 |
| 2012/0006856 | A1 * | 1/2012 | Dennis | 222/382 |
| 2012/0241474 | A1 * | 9/2012 | Dennis | 222/137 |
| 2012/0241475 | A1 * | 9/2012 | Dennis | 222/137 |
| 2012/0280065 | A1 * | 11/2012 | Foster et al. | 239/375 |

* cited by examiner

NON-FLAMMABLE PLASTIC AEROSOL

BACKGROUND OF THE INVENTION

1. Field of the Invention

This invention relates to a non-flammable formulation for use in a plastic aerosol container.

2. Description of the Related Art

Pressurized containers for dispensing aerosols are well known in the art, and are typically constructed of metal in order to withstand the inherent internal pressure of aerosols. However, it is desirable to provide a plastic container capable of withstanding the internal pressures generated by an aerosol because plastic has many advantages over metal. Several approached have been described to overcome the problems associated with plastic aerosol containers. Reinforced plastic aerosol containers are described in U.S. Pat. No. 7,303,087 to Flashinski et al. Heat treatment of plastic aerosol containers is described in U.S. Pat. No. 6,959,524 to Altonen et al. The use of compressed gas propellants to avoid problems with liquefied gas propellants is described in U.S. Pat. No. 7,448,517 to Shieh et al. An aerosol container having a vapor tap valve for an immiscible propellant is described in U.S. Pat. No. 4,393,984 to Debard.

To overcome these problems of prior art plastic aerosol products, aerosols of the present invention are designed to integrate the container, the valve, the propellant formulation with the liquid formulation to achieve a stable product and container that will deliver a non-flammable aerosol.

SUMMARY OF THE INVENTION

In accordance with the above objects and those that will be mentioned and will become apparent below, one aspect of the present invention comprises an aerosol device comprising a plastic aerosol container having an actuator, a valve and a dip tube, wherein the container contains an aerosol product composition comprising an aqueous composition having less than 20% water; greater than 50% of an alcohol solvent selected from the group consisting of isopropanol, ethanol, and combinations thereof; 4% to 10% of an alcohol cosolvent; 0.2% to 0.5% of a quaternary antibacterial agent; 0.05% to 0.5% of a fragrance; and 30% to 35% of a propellant comprising a non-flammable hydrofluorocarbon propellant wherein the propellant is at least partially miscible with the aqueous composition; wherein the product composition forms at least a propellant vapor phase and an aqueous liquid phase and the valve has a vapor tap valve orifice fluidly connected to the propellant vapor phase and the dip tube is fluidly connected to the aqueous liquid phase.

In accordance with the above objects and those that will be mentioned and will become apparent below, another aspect of the present invention comprises an aerosol device comprising a plastic aerosol container having an actuator, a valve and a dip tube, wherein the container contains an aerosol product composition comprising an aqueous composition comprising greater than 50% isopropanol; and a non-flammable hydrofluorocarbon propellant wherein the propellant is at least partially miscible with the aqueous composition; wherein the product composition forms at least a propellant vapor phase and an aqueous liquid phase and the valve has a vapor tap valve orifice fluidly connected to the propellant vapor phase and the dip tube is fluidly connected to the aqueous liquid phase.

In accordance with the above objects and those that will be mentioned and will become apparent below, another aspect of the present invention comprises an aerosol device comprising a plastic aerosol container comprising PET and having an actuator, a valve and a dip tube, wherein the container contains an aerosol product composition comprising an aqueous composition with less than 20% water; greater than 50% of an alcohol solvent selected from the group consisting of isopropanol, ethanol, and combinations thereof; 4% to 10% of an alcohol cosolvent; 0.05% to 0.5% of a fragrance; and 30% to 35% of a propellant comprising 1,1-difluoroethane wherein the propellant is at least partially miscible with the aqueous composition; wherein the product composition forms at least a propellant vapor phase and an aqueous liquid phase and the valve has a vapor tap valve orifice fluidly connected to the propellant vapor phase and the dip tube is fluidly connected to the aqueous liquid phase.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION OF THE INVENTION

Figure 1:
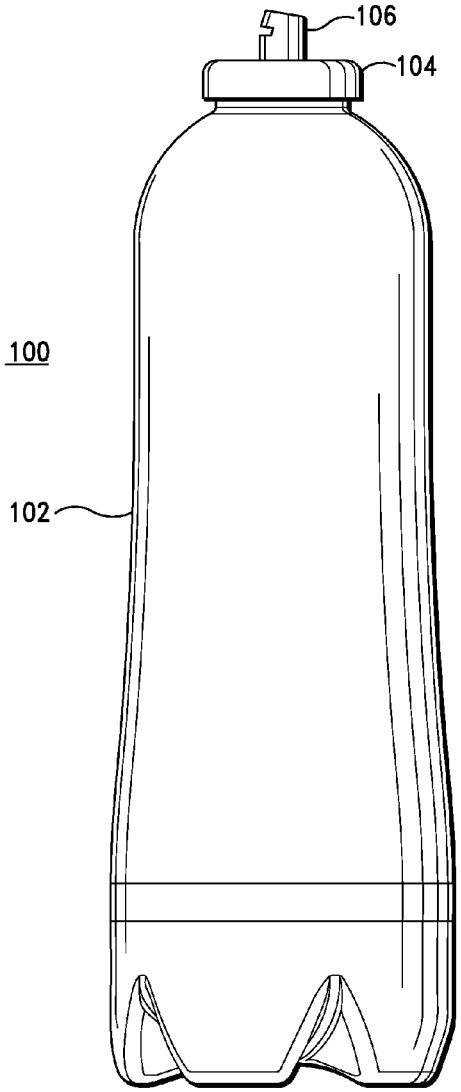
FIG. 1 shows a side view of a plastic aerosol device in accordance with an embodiment of the present invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the product composition alone.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, and/or amphoteric agents.

The aerosol composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

The term "aerosol" will be understood herein to encompass both aerosols, literally, and other liquid or flowable products that can be dispensed from pressurized containers in a manner comparable to aerosolized products. Such products include but are not limited to foamed or gel preparations or to liquid products delivered in a non-aerosol stream. It is also herein contemplated that the present invention may be practiced in many consumer products including, but not limited to, cleaners, disinfectants, antiperspirants, deodorants, hairsprays, cooking sprays, beverages, perfumes, shaving creams/gels, or drug products.

The term "aerosol composition" as used herein means any composition that is pressurized from a gas and/or liquefied gas propellant, wherein the propellant provides a way for pushing or moving the composition to and/or through an application device. These aerosol products can deliver the composition to its targeted source (e.g., hard surface, air, consumers skin, hair, underarm, etc.) in various ways including, but not limited to, a spray or via a porous application surface.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

The term "plastic aerosol container" refers to the non-refillable container vessel of the pressurized package being made substantially of plastic and fitted with a sealing valve and actuator. The sealing valve and actuator of the package may or may not necessarily be made substantially of plastic.

The term "pressurized plastic container" or "pressurized plastic package" is defined herein as a container with contents, where the contents have a pressure of at least 10 PSI greater than atmospheric pressure at 25° C.

Several types of propellants are used to pressurize the container of the present invention. These materials include non-flammable, liquefied gas propellants, including hydrofluorocarbon (HFC) propellants. Preferred HEC propellants are 1,1,1,2-tetrafluoroethane (HFC-134(a)) and 1,1,1,2,3,3,3,-heptafluoropropane (HFC-227). HFC-134(a) is particularly preferred. Other examples of HFC propellants are HFC-32 (difluoromethane), HFC-143(a) (1,1,1-trifluoroethane), tetrafluoroethane), and HFC-152a (1,1-difluoroethane). The preferred propellant is 1,1-difluoroethane. The composition weight percentage of HFC propellant is in the range of 20 to 40% of the final weight, or 29% to 40%, or 30% to 35%, or 30% propellant. The propellant is at least partially soluble in the aerosol formulation. In some embodiments, part of the HFC propellant is replaced by a hydrocarbon propellant, for example isobutane. The hydrocarbon propellant is limited to less than 10% by weight of the total composition.

A suitable organic solvent is for the aerosol formulation is isopropanol or ethanol, preferably isopropanol. The solvent is present in 45% to 65%, or 50% to 60%, or greater than 50% weight of the composition.

The aerosol formulation should contain a co-solvent. Suitable organic co-solvents for use in the invention include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. Preferred co-solvents are triethylene glycol and diethylene glycol, preferrably triethylene glycol. The co-solvents can be present at a level of from 4% to 10%, or greater than 5% by weight of the composition.

The aerosol formulation may contain one or more surfactants selected from nonionic, anionic, ampholytic, amphoteric and zwitterionic surfactants and mixtures thereof. A typical listing of nonionic, anionic, ampholytic, and zwitterionic classes, and species of these surfactants, is given in U.S. Pat. No. 3,929,678 to Laughlin and Heuring. One example of an anionic surfactant is sodium lauryl sulfate. The surfactants are preferably not present or present in amount less than 0.1% by weight, but may be present at a level of from 0.1% to 2%.

The aerosol composition may include antimicrobial agents for purposes of disinfection, sanitization, sterilization, or microbiological control. Antimicrobial agents, include carboxylic acids, such as 2-hydroxycarboxylic acids, quaternary ammonium compounds, metal salts and phenolics. Non-limiting examples of these quaternary compounds include benzalkonium chlorides and/or substituted benzalkonium chlorides, di($C_6$-$C_{14}$)alkyl di-short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. Suitable quaternary compounds include the group consisting of dialkyl dimethylammonium chlorides, alkyl dimethylbenzylammonium chlorides, alkyl dimethylethylbenzylammonium chlorides, dialkyl methylbenzylammonium chlorides, and mixtures thereof. Other suitable quaternary compounds include biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts. Preferred quaternary compounds are n-alkyl dimethylbenzylammonium chlorides, n-alkyl dimethylethylbenzylammonium chlorides, and mixtures thereof. The antibacterial agents are preferably present in an amount of from 0.15% to 0.5% by weight, or 0.2% to 0.3%, or 0.2% to 0.25%, or 0.2%.

The aerosol compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. The composition preferably contains a fragrance in an amount of 0.2% to 0.7%, or 0.3% to 0.5% by weight of the compositon.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®), morpholine, and/or short chain alcohols (e.g. ethanol and/or IPA). The mildewstat or bacteriostat includes, but is not limited to, mildewstats (including non-isothiazolone compounds) include Kathon GC®, a 5-chloro-2-methyl-4-isothiazolin-3-one, KATHON ICP®, a 2-methyl-4-isothiazolin-3-one, and a blend thereof, and KATHON 886®, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL CRL®, a propyl-p-hydroxybenzoate, from ICI PLC; NIPASOL M®, an o-phenyl-phenol, $Na^+$ salt, from Nipa Laboratories Ltd., DOWICIDE A®, a 1,2-Benzoisothiazolin-3-one, from Dow Chemical Co., and IRGASAN DP 200®, a 2,4,4'-trichloro-2-hydroxydiphenylether, from Ciba-Geigy A.G.

The aerosol composition may include a builder or buffer, which may increase the effectiveness of the composition. The builder or buffer can also function as a sequestering agent in the composition. A variety of builders or buffers can be used and they include, but are not limited to, phosphate-silicate compounds, zeolites, alkali metal, ammonium and substituted ammonium poly-acetates, trialkali salts of nitrilotriacetic acid, carboxylates, polycarboxylates, carbonates, bicarbonates, polyphosphates, aminopolycarboxylates, polyhydroxy-sulfonates, and starch derivatives. Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form. The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine. Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl)amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis (methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, acetic acid. Mixtures of any of the above are also acceptable. Useful inorganic buffers/alkalinity sources include ammonium hydroxide, the alkali metal carbonates and alkali metal phosphates, e.g., sodium carbonate, sodium polyphosphate. Other suitable pH adjusting agents include sodium or potassium hydroxide. When employed, the builder, buffer, or pH adjusting agent comprises at least 0.001% and typically 0.01% to 5% of the aerosol composition. Suitably, the builder or buffer content is from 0.1% to 1%.

The aerosol composition is preferably an aqueous composition, water can be, along with the solvent, a predominant ingredient. Although water can normally contribute to making a composition non-flammable, large amounts of water can contribute to composition instability and create unsuitable droplets exiting the aerosol valve. The water can be present at a level of less than 20%, or less than 10% by weight of the composition. Deionized water is preferred.

Plastic aerosol containers are described in U.S. Pat. No. 7,028,866 to Kunesh et al., U.S. Pat. No. 6,959,524 to Altonen et al., U.S. Pat. App. 2003/0215400 to Schroeder et al., U.S. Pat. No. 6,390,326 to Hung, U.S. Pat. No. 5,152,411 to Pope et al., U.S. Pat. No. 6,491,187 to Walters, U.S. Pat. No. 7,344,707 to Smith, U.S. Pat. No. 5,553,753 to Abplanalp, U.S. Pat. No. 5,199,615 to Downing et al., all of which are incorporated herein by reference in their entirety. The thermoplastic materials, which can be used, are generally polymers such as polyethylene (PE) or polyethylene terephthalates (PET), polyethylene glycol terephthalates or polypropylene (PP). Polyamide (PA) or ethylenevinyl alcohol (EVOH) can be used for possible further layers situated between the inner or outer edge layers. However, it is also possible to use any other plastics which are melt processable. Suitable containers can be produced from PET homopolymers, physical PET/PEN resin blends, polyethylene naphthalene (PEN) copolymers, or PEN homopolymers.

Figure 2:
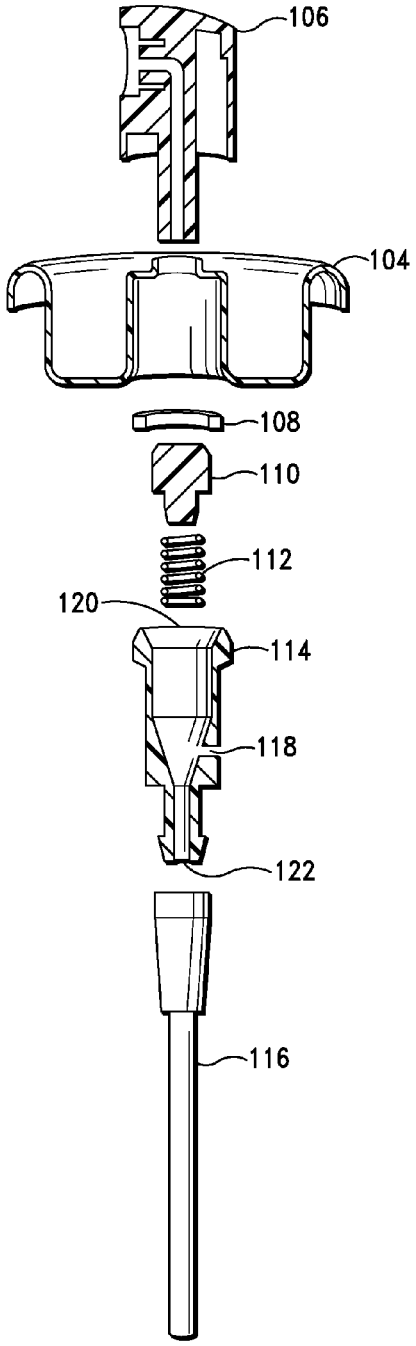
FIG. 2 shows an exploded of the integral working of the device of FIG. 1.
Figure 3:
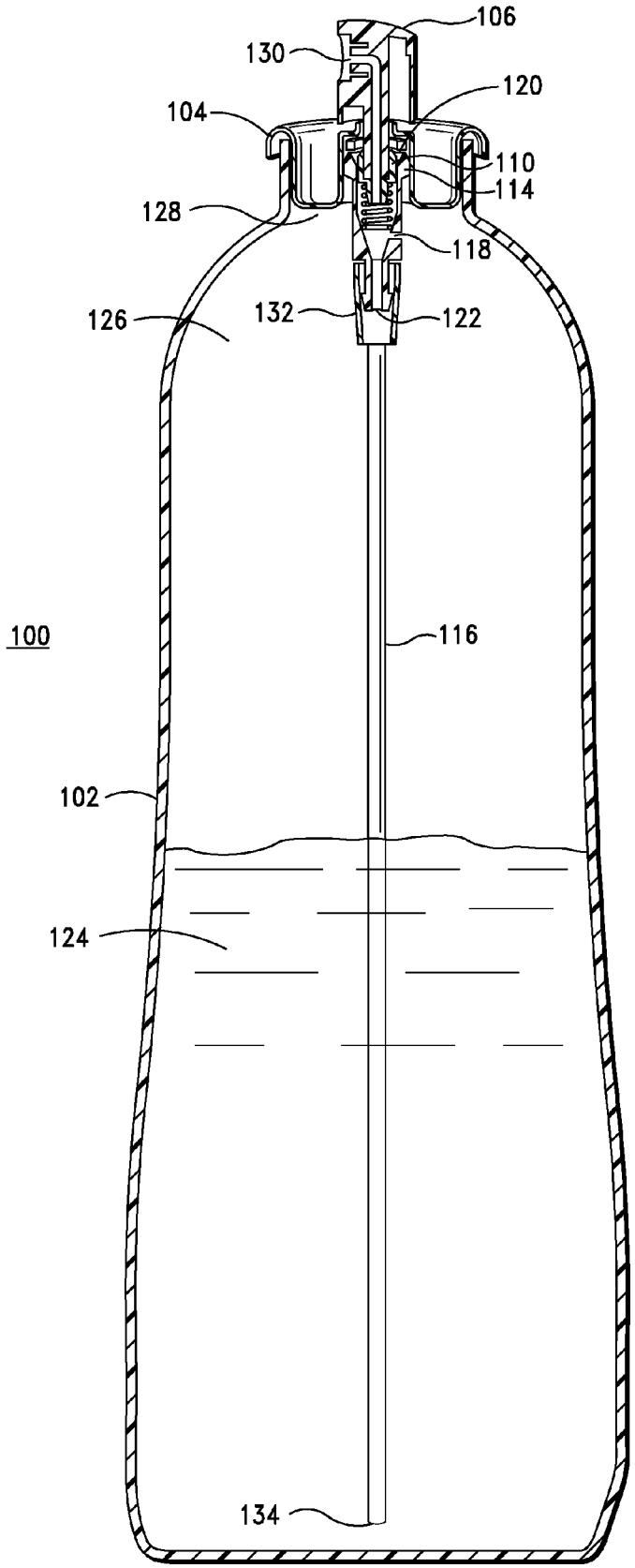
FIG. 3 shows a cross-sectional view of the device of FIG. 1 of FIG. 1.

FIG. 1 shows an assembled plastic aerosol container 100 of the invention with a container body 102, a mounting cup 104, and an actuator 106. FIG. 2 shows an exploded view of the internal workings of the aerosol container 100 with an actuator 106, a mounting cup 104, a gasket 108, a valve body seal 110, a spring 112, a valve body 114 and a dip tube 116. The valve body 114 contains a vapor tap orifice 118. The dip tube 116 attaches to the valve body bottom opening 122. The gasket 108 forms an air tight seal between the mounting cup 104 and the valve body 114. FIG. 3 shows a cross-section of the assembled container 100 of FIG. 1, showing both the container body 102, the aerosol product composition liquid phase 124, and the propellant vapor phase 126. The plastic aerosol container 100 has a container body 102 with a container top opening 128. The top opening 128 of the container body 102 is sealed with the mounting cup 104. The mounting cup 104 holds the valve body 114 with the valve body seal 110. The actuator 106 having a terminal orifice 130 is connected to the valve body top opening 120 with the seal 110. The dip tube 116 is connected to the valve body bottom opening 122 at the dip tube top end 132. The valve body 114 contains a vapor tap orifice 118. The vapor tap orifice 118 is fluidly connected to the propellant vapor phase 126. The dip tube bottom end 134 is fluidly connected to the aerosol product composition liquid phase 124. A suitable actuator, valve body and mounting cup are available from Precision Valve Company™ or Aptar™.

EXAMPLES

Examples of suitable inventive aerosol compositions are given in Tables I and II.

TABLE I

| Components | A | B | C | D | E |
|---|---|---|---|---|---|
| Triethylene glycol | 6.00 | 5.50 | 5.10 | 6.00 | 5.50 |
| Diethylene glycol | | | | | |
| Isopropanol | 54.0 | 51.0 | 55.0 | | |
| Ethanol | | | | 54.0 | 51.0 |
| Mixture of n-alkyl dimethylbenzyl-ammonium chloride and n-alkyl dimethylethylbenzyl-ammonium chloride | 0.40 | | 0.20 | 0.40 | |
| Ammonium hydroxide | 3.00 | 1.00 | 0.05 | | |
| Morpholine | 0.10 | 0.10 | | | |
| Fragrance | 0.50 | 0.30 | 0.25 | 0.50 | 0.30 |
| 1,1-Difluoroethane | 30.0 | 35.0 | 24.0 | 30.0 | 35.0 |
| Isobutane | | | 7.0 | | |
| Water | Balance | Balance | Balance | Balance | Balance |

TABLE II

| Components | F | G | H | I | J |
|---|---|---|---|---|---|
| Triethylene glycol | 6.00 | 5.50 | | 6.00 | 5.50 |
| Diethylene glycol | | | 4.00 | | |
| Isopropanol | 54.0 | 51.0 | 55.0 | 60.0 | 51.0 |

TABLE II-continued

| Components | F | G | H | I | J |
|---|---|---|---|---|---|
| Mixture of n-alkyl dimethylbenzyl-ammonium chloride and n-alkyl dimethylethylbenzyl-ammonium chloride | 0.40 | | 0.20 | 0.40 | |
| Ammonium hydroxide | 3.00 | 1.00 | 0.05 | | |
| Morpholine | 0.10 | 0.10 | | | |
| Fragrance | 0.50 | 0.30 | 0.25 | 0.50 | 0.30 |
| Sodium lauryl sulfate | 0.05 | | | | |
| 1,1-Difluoroethane | 30.0 | 30.0 | 33.0 | 30.0 | 30.0 |
| Water | Balance | Balance | Balance | Balance | Balance |

The vapor tap valve contributes to reducing the particle size of the aerosol product composition in use to give a dry aerosol. However, the particle size can also be controlled by the product composition and the ratio of propellant to the rest of the composition. When the particle size distribution is too large, the aerosol product composition is wet and not effective in use. When the particle size distribution is too small, for example greater than 15% of particles less than 10 microns, the use of the aerosol product composition may present a breathing hazard or contribute to flammability of the composition. Table III illustrates products with acceptable and unacceptable particle size distributions.

TABLE III

| Product | Mean Particle Size, microns | % Particle Size less than 10 microns | |
|---|---|---|---|
| Commercial Aerosol in metal can without vapor tap valve | 115 | | wet |
| Sample 1, 30% aqueous composition/ 70% propellant with vapor tap valve | 10 | 54 | dry |
| Sample 2, 60% aqueous composition/ 40% propellant with vapor tap valve | 39 | 4 | dry |
| Sample 1, 70% aqueous composition/ 30% propellant with vapor tap valve | 43 | 6 | dry |

This invention has been described herein in detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

We claim:

1. An aerosol device comprising:

a. a plastic aerosol container having an actuator, a valve, a vapor tap valve orifice, and a dip tube, wherein the container contains an aerosol product composition comprising:

i. an aqueous composition having less than 20% water;

ii. greater than 50% by weight of an alcohol solvent selected from the group consisting of isopropanol, ethanol, and combinations thereof;

iii. optionally, 4% to 10% by weight of an alcohol cosolvent;

iv. 0.2% to 0.5% by weight of a quaternary ammonium compound selected from the group consisting of n-alkyl dimethylbenzylammonium chloride, n-alkyl dimethylethylbenzylammonium chloride, and mixtures thereof;

v. optionally, 0.05% to 0.5% by weight of a fragrance; and vi. about 20% to 40% by weight of one or more propellants wherein the only propellants in the product composition consist of: one or more non-flammable hydrofluorocarbon propellants; and b. wherein the combined content of the alcohol solvent and the propellants is equal to about 80% or more of the composition by weight.

c. wherein

2. The aerosol device of claim 1, wherein the product composition comprises a hydrocarbon propellant at a level which is less than 10% by weight of the product composition.

3. An aerosol device comprising:

a. a plastic aerosol container having an actuator, a valve, a vapor tap valve orifice, and a dip tube, wherein the container contains an aerosol product composition consisting of:

i. greater than 50% by weight of an alcohol solvent;

ii. 1% to 15% by weight of water;

iii. a quaternary ammonium compound selected from the group consisting of n-alkyl dimethylbenzylammonium chloride, n-alkyl dimethylethylbenzylammonium chloride, and mixtures thereof;

iv. optionally, one or more of the following adjuncts selected from the group consisting of: co-solvents, surfactants, builders, buffers, stain and soil repellants, lubricants, odor control agents, perfumes, fragrances, fragrance release agents, bleaching agents, acids, electrolytes, dyes, colorants, solubilizing materials, stabilizers, thickeners, defoamers, hydrotropes, cloud point modifiers, preservatives, and other polymers; and v. about 20% to 40% by weight of one or more propellants comprising: a non-flammable hydrofluorocarbon propellant and wherein the propellant optionally comprises a hydrocarbon propellant at a level which is less than 10% by weight of the composition; and b. wherein the combined content of the alcohol solvent and the propellants is equal to about 80% or more of the composition by weight.

4. The aerosol device of claim 3, wherein the container comprises PET.

5. The aerosol device of claim 3, wherein the propellant comprises 1,1-difluoroethane.

6. The aerosol device of claim 3, wherein the propellant comprises 30% to 40% by weight of the product composition.

7. The aerosol device of claim 3, wherein the propellant comprises only a hydrofluorocarbon propellant.

8. The aerosol device of claim 3, wherein the product composition comprises 1% to 10% by weight of water.

9. The aerosol device of claim 3, wherein the product composition comprises a co-solvent selected from the group consisting of triethylene glycol, diethylene glycol, and combinations thereof.

10. The aerosol device of claim 3, wherein the product composition comprises greater than 5% by weight triethylene glycol.

11. The aerosol device of claim 3, wherein the product composition comprises less than 0.1% by weight surfactant.

12. The aerosol device of claim 3, wherein the product composition comprises a preservative.

* * * * *